United States Patent [19]

Baier

[11] Patent Number: 4,846,242

[45] Date of Patent: Jul. 11, 1989

[54] ROLL SHUTTER FOR ROOF WINDOWS

[76] Inventor: Paul Baier, Reiersbacher Str. 28+108, 7592 Renchen-Ulm, Fed. Rep. of Germany

[21] Appl. No.: 234,135

[22] Filed: Aug. 19, 1988

[30] Foreign Application Priority Data

Oct. 26, 1987 [DE] Fed. Rep. of Germany ..... 3736153

[51] Int. Cl.[4] ..... E06B 9/264

[52] U.S. Cl. ..... 160/32; 160/133

[58] Field of Search ..... 160/32–36, 160/133

[56] References Cited

U.S. PATENT DOCUMENTS

| | | | |
|---|---|---|---|
| 1,047,248 | 12/1912 | Kunkle | 160/32 |
| 2,434,786 | 1/1948 | Browning | 160/34 |
| 3,522,834 | 8/1970 | Corcoran | 160/133 X |
| 3,840,061 | 10/1974 | Herms | 160/133 X |
| 3,878,879 | 4/1975 | Manns | 160/273.1 |
| 3,970,134 | 7/1976 | Sinnock et al. | 160/133 |
| 3,981,343 | 9/1976 | De Vito | 160/133 X |
| 4,691,753 | 9/1987 | Baier | 160/32 |

FOREIGN PATENT DOCUMENTS

| | | | |
|---|---|---|---|
| 2237737 | 2/1974 | Fed. Rep. of Germany | 160/133 |
| 3010223 | 9/1981 | Fed. Rep. of Germany | 160/32 |
| 3442709 | 5/1986 | Fed. Rep. of Germany . | |
| 3415551 | 2/1987 | Fed. Rep. of Germany . | |
| 2266789 | 10/1975 | France | 160/133 |
| 2556403 | 6/1985 | France | 160/265 |
| 429105 | 7/1967 | Switzerland . | |
| 2016066 | 9/1979 | United Kingdom | 160/133 |

*Primary Examiner*—Ramon S. Britts
*Assistant Examiner*—David G. Kolman
*Attorney, Agent, or Firm*—Wigman & Cohen

[57] ABSTRACT

A roll shutter for roof windows, particularly of the hinged casement-type construction, including a roll shutter draw mechanism having two cords, one end of each of which is attached to the lower end of the roll shutter plating. The ends of the two cords are connected to a common cord which after being guided over stationary diverting elements is guided to a drivable spool. In addition, the roll shutter draw mechanism includes a length compensating device having a diverting element which can slide against the force of an elastic member and over which the two cords are guided in tandem. The length compensating device has at least one additional diverting element which can slide together with the slidable diverting element, and the cords are guided in their path from one slidable diverting element to the next by passing over a stationary diverting element.

16 Claims, 4 Drawing Sheets

Fig.2
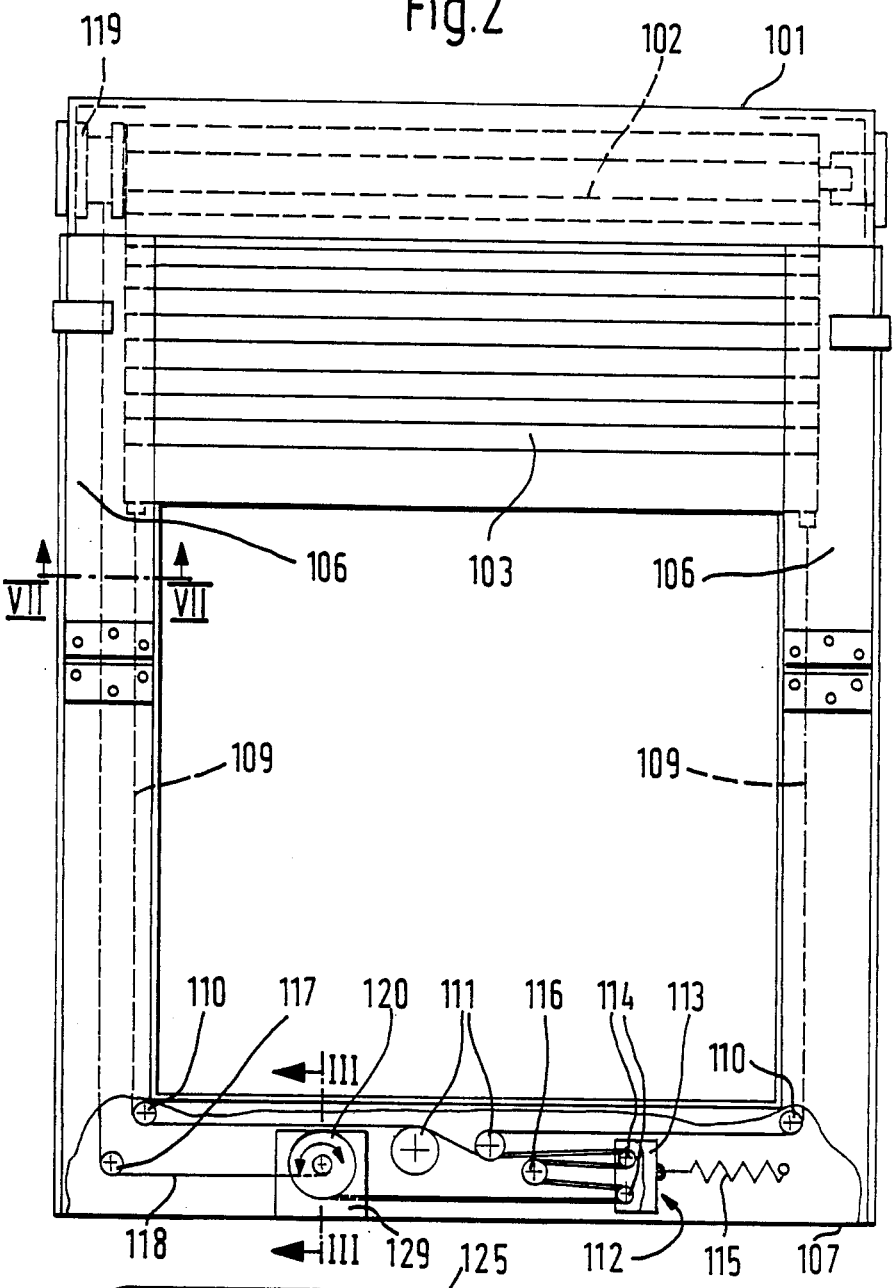
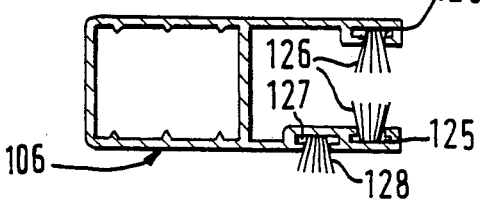
Fig. 7

ROLL SHUTTER FOR ROOF WINDOWS

BACKGROUND OF THE INVENTION

The invention relates to a roll shutter for roof windows of the casement-type construction, and more particularly to roll shutters which include a frame in which a storage shaft is rotatably arranged, two guide rails which extend parallel to one another and are disposed adjacent to the frame and a roll shutter draw mechanism. The guide rails are provided for the ends of the roll shutter bars, and include a crossbar which connects the guide rails with each other at ends thereof opposite the frame. The roll shutter draw mechanism includes two cords, one end of each of which is attached to the lower end of the roll shutter plating. The two cords are joined to a single common cord, which extends over stationary diverting elements to a drivable spool. The roll shutter mechanism also includes a length compensating device having a diverting element which is slidable against the force of an elastic member and over which the two cords are guided in tandem.

In a known roll shutter of this type (DE-OS No. 34 15 551), a holder is suspended on the elastic member, to support the movable diverting element. However, in this known apparatus, it is necessary to provide an elastic member which exerts a relatively large force in order to assure that, as the roll shutter plating is unwound from the storage shaft, the lower end of the roll shutter plating moves appropriately toward the crossbar without binding, even when subjected to differing conditions of friction.

OBJECTS AND ADVANTAGES OF THE INVENTION

It is therefore a primary object of the invention to provide a roll shutter for roof windows of the above-described type having an improved roll shutter draw mechanism. This object is achieved by providing the length compensating device with at least one additional slidable diverting element and by guiding the cords in a path from one slidable diverting element to the next over a stationary diverting element.

By providing the length compensating device with at least one additional slidable diverting element, it is possible to achieve a guidance for the cords of the roll shutter draw mechanism which results in a significant reduction in the slide path of the slidable diverting elements. The path over which the elastic member must expand and contract is also reduced accordingly. In consequence, the difference in the tensile force of the elastic member at maximum and minimum extension can be reduced, and the tensile force acting on the roll shutter plating can thereby be equalized. In addition, this makes it possible to avoid an over extension of the elastic member.

An additional significant advantage of the present invention is that the roll shutter draw mechanism can be selectively motor-driven or manually driven with no problem.

In the case of manual operation of the roll shutter, the storage shaft for the roll shutter plating does not need to be coupled with a spiral spring to produce the winding torque because, due to the length compensating device, the drive torque can be produced by means of a spool arranged on the storage shaft, to which spool is attached one cord of the roll shutter draw mechanism.

The cords are preferably formed as belts or bands so that an orderly coiling onto the spool or spools is assured without special separate measures.

In the case of motorized operation of the roll shutter, the draw mechanism includes an electric motor which is preferably integrated into the storage shaft. In this arrangement, a spool is mounted on the storage shaft so as to rotate therewith, and the common cord of the roll shutter draw mechanism, which extends in one of the two guide rails, is wound onto the spool as the roll shutter is closed, so that during the closing process the cords exert a force on the lower end of the roll shutter plating in the direction of the side rails.

Where the roll shutter is driven manually, the spool, driven by means of a crank, is preferably rotatably mounted in the crossbar or in a housing provided on the underside of the crossbar. The inner chamber of the housing communicates with that of the crossbar which received the spool in the crossbar. In addition to a first chamber for the receipt of the common cord, the spool includes a second chamber for an additional cord with an opposite coiling direction, which cord leads from this chamber to a spool arranged on the storage shaft so as to rotate therewith. Depending on the direction the crank is rotated then, either a torque is exerted on the storage shaft tending to roll up the roll shutter plating or a tensile force is exerted on the lower end of the roll shutter tending to close the roll shutter, whereby due to the length compensation device according to the invention, the movement of the roll shutter plating in both directions is much easier and more uniform.

The two chambers of the spool are advantageously separated from each other by a piece of sheet metal or the like at least in the side where the cords enter or exit. In this manner the cords are prevented from passing from one chamber into the other. The separating wall extends advantageously as far as the boundary wall of the crossbar. Where the two chambers are formed by different respective rollers, the separating wall of sheet metal or the like can also separate these rollers from each other.

Where the spool is located in a housing provided on the underside of the crossbar, the connection with the crank can be established even more easily because the angle between the spool axis and the crank axis is relatively small. A universal joint could optionally be used instead of a diverting or angular drive.

A transmission can be inserted between the crank and the spool shaft driven thereby, which transmission is preferably rigidly connected with the crossbar. Alternatively, if a housing for the spool is provided on the underside of the crossbar, it can be connected to this housing. The crank can be nondetachably coupled with the spool shaft. Then the lower side of the window wing does not have to have a drive shaft passing through it. If, however, it is desired to activate the roll shutter even when the window is closed, then a shaft passing through this side of the window wing is necessary. The torque to be transferred, however, is so slight that a relatively small diameter is sufficient for this shaft.

A further feature of the present invention is the use of strip-like light sealing elements to achieve a complete light seal. These sealing elements not only contact the roll shutter plating, but also close any gaps between the roll shutter and the associated window wing so as to seal out light.

BRIEF DESCRIPTION OF THE DRAWINGS

The invention is described in greater detail below with the aid of exemplary embodiments illustrated in the drawings, in which:

FIG. 2 is a partial breakaway top view of a second exemplary embodiment,

FIG. 7 is a cross-section taken along the line VII—VII in FIG. 2.

DETAILED DESCRIPTION OF THE PREFERRED EMBODIMENTS

Figure 1:
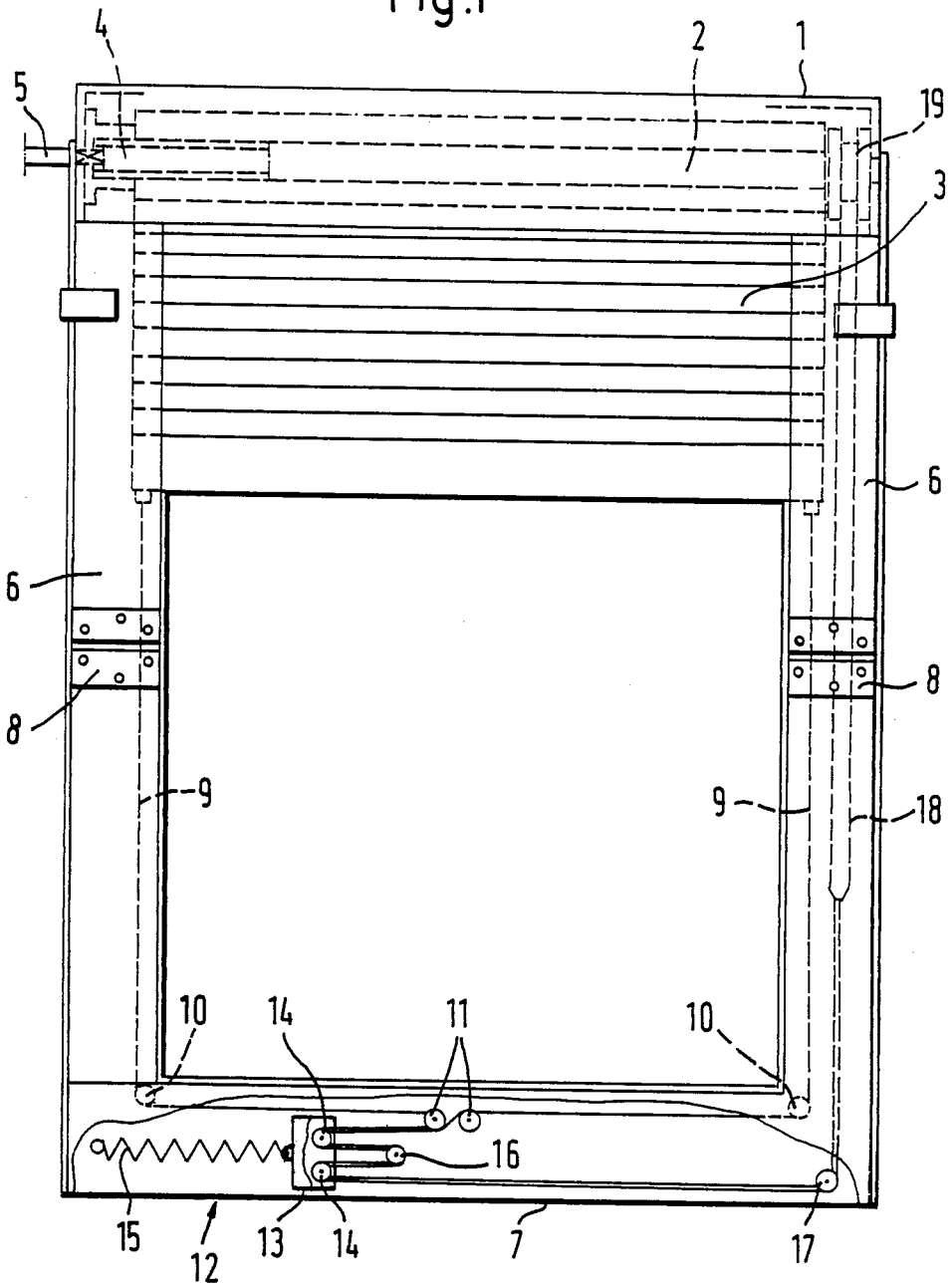
FIG. 1 is a partial breakaway top view of a first exemplary embodiment.

Referring now to FIG. 1 of the drawings, there is shown a roll shutter for an arrangement on the outside of a hinged casement-type roof window which includes a roll shutter frame 1 constructed in a known manner, in which a storage shaft 2 for a roll shutter plating 3 comprised of individual bars is rotatably mounted. An electric motor 4 with a selectable direction of rotation engages in the hollow storage shaft 2 and is connected therewith on one side, and on the other side is connected with the roll shutter frame 1 so as to rotate therewith, so that, depending on the selected direction of rotation of the electric motor, the storage shaft 2 can be driven in one rotation direction or the other. A cable leading to the electric motor 4 is designated with the numeral 5.

The roll shutter frame 1 is rigidly connected with the upper ends of two parallel guide rails 6, the lower ends of which are rigidly connected with a crossbar 7. Both of the guide rails 6 as well as the crossbar 7 contain a groove which is rectangular in cross-section to guide and receive the edge portions of the roll shutter plating 3, and a chamber adjoining the base of these grooves, which chambers are also rectangular in cross section. As shown in FIG. 1, the two guide rails 6 are divided in half at about their midpoint and the adjacent end portions are connected with each other by respective hinges 8. The lower portion of each of the guide rails 6 is rigidly connected with the frame of the window wing supporting it and the upper portion thereof is connected with the frame of the window wing supporting it in such a manner as to be longitudinally slidable. During the pivoting movement of the window wing, therefore, the upper portion of the top guide rails 6 and the roll shutter frame 1 perform a movement relative to the window wing.

The roll shutter draw mechanism includes two fabric belts 9 extending from the lower end of the roll shutter on opposite sides thereof. The upper end of each belt is attached to the lower end of the roll shutter plating 3 in the area of one or the other of the end sections engaging in the guide rails 6. The two fabric belts 9 each extend downwardly in their respective guide rails to respective first diverting rollers 10 which are rotatably mounted in the crossbar 7. From here the two fabric belts 9 extend toward each other to respective second diverting rollers 11. The two diverting rollers 11 are, in the exemplary embodiment, rotatably arranged in proximity to one another at about the midpoint of the crossbar 7, and are spaced from each other below the groove in the guide rail 6 which receives the end of the roll shutter. The two second diverting rollers 11 lead the two fabric belts 9 to a point where they meet, and the two fabric belts 9 then run in the longitudinal direction of the crossbar 7 to a length compensating device designated generally with the numeral 12.

The length compensating device 12, which is arranged in the chamber of the crossbar 7, includes a diversion element or holder 13 which is movable in the longitudinal direction of the crossbar 7, and which is shown in FIG. 1 (in a breakaway illustration) as having a U-shaped configuration with two diverting rollers 14 rotatably supported between opposing side panels of the diversion element or holder 13. A biased helical spring 15 extends in the longitudinal direction of the crossbar 7, and has one end connected to a yoke portion of diversion element or holder 13 and its opposite end secured to crossbar 7. The diverting rollers 14 can therefore move together with the diversion element or holder 13 against the force of the helical spring 15 in the longitudinal direction of the crossbar toward the center portion thereof, where the second diverting rollers 11 are arranged.

The two fabric belts 9 extending from the second diverting rollers 11 are guided first over the upper diverting roller 14 in the length compensating device 12, then around a stationary third diverting roller 16 in the crossbar 7, then back to the lower diverting roller 14 and then in the longitudinal direction of the crossbar 7 to a fourth stationary diverting roller 17 arranged in the corner area between the crossbar 7 and one of the guide rails 6. From here the two fabric belts 9 run in the chamber of the guide rail 6 shown at the right of FIG. 1 toward the roll shutter frame 1. However, in the lower portion of this guide rail 6 they are securely connected with each other and with a third fabric belt 18, which leads to a spool 19 arranged on the storage shaft 2 so that the spool 19 rotates with the shaft 2. The third fabric belt 18 is partially wound on the spool 19 in such a manner that when the storage shaft 2 rotates in the sense of closing the roll shutter, the third fabric belt 18 is wound up. In this manner it is assured that when the roll shutter plating 3 is uncoiled from the storage shaft 2 a uniform pull in a downward direction, i.e., in a direction toward the crossbar 7, is exerted on its lower end.

Here, it is appropriate to discuss a basic principle of the present invention. The length compensating device 12 of the embodiment of FIG. 1, as well as the length compensating devices of the embodiments to be discussed in detail hereinafter, operate on the principle of a block and tackle arrangement. The block and tackle arrangement is formed in the embodiment of FIG. 1 by the two slidable diverting elements 14, slidable against the force of spring 15, by the stationary diverting element 16, and by the two cords 9 which are trained around elements 14, 16, and 14, respectively. According to this arrangement, the slidable diverting elements 14 only travel half the length compared with the variation of the length of the cords 9. While in the embodiment of FIG. 1 there are illustrated two slidable diverting elements 14 and one stationary diverting element 16, it is apparent to a person having knowledge of the block and tackle principle that the length compensating device 12 of FIG. 1 may be replaced by an arrangement in which the two diverting elements 14 are held stationary and the single diverting element 16 is slidable against the force of spring 15, in accordance with the scope of the present invention. To achieve the desired effect it is only necessary that the diverting elements form a block and tackle arrangement, which means that there must be at least three diverting elements, and that the cords or cord are guided alternately about stationary and slidable elements, respectively, to form the block and tackle arrangement.

Additionally, it is possible to form the block and tackle arrangement with more than three diverting elements. In this case, the length of travel of the slidable elements is even further reduced compared with the length variations of the loop of the cord or cords.

In the exemplary embodiment shown in FIG. 2, which is also provided for arrangement on the outside of a hinged wing, the roll shutter frame 101, the roll shutter plating 103, the guide rails 106 and the crossbar 107 are formed in the same manner as in the first exemplary embodiment. Also, as in the first exemplary embodiment, the lower portion of the guide rail 106 is rigidly fixed to the frame of the hinged wing, while the upper portion is slidably connected to the roll shutter frame 101.

The storage shaft 102 for the roll shutter plating 103 can also be motor-driven. It therefore carries only one spool 119, which is fixed to shaft 102 so as to rotate therewith.

A length compensating device 112 is arranged in the chamber of the crossbar 107, which device 112 is formed in the same manner as that in the first exemplary embodiment. Also, as in the first exemplary embodiment, the diversion element or holder 113, which is illustrated in breakaway, together with its two diverting rollers 114 can be moved against the force of the biased helical spring 115 in the longitudinal direction of the crossbar 107.

Two fabric belts 109, one end of each of which, as in the first exemplary embodiment, is attached to the lower end of the roll shutter plating 103, run in the groove of the guide rails 106 to respective first diverting rollers 110. From these diverting rollers 110, which are rotatably mounted in the crossbar 107, the fabric belts 109 run toward each other to two second diverting rollers 111 arranged in the center section of the crossbar 107. From there the two fabric belts 109 come into contact with each other and are diverted together to the length compensating device 112. After being diverted by the upper diverting roller 114 in the diversion element or holder 113, then by the third diverting roller 116 which is stationarily mounted in the crossbar 107 and then by the lower diverting roller 114, the two fabric belts 109 together extend to a spool 120 rotatably mounted in the crossbar 107. It would also be possible, however, to combine both of the fabric belts 109 with a third fabric belt before they reach the spool 120 and to wind only the third belt onto the spool 120.

Figure 3:
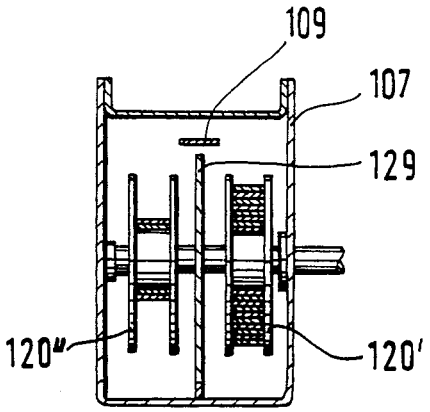
FIG. 3 is an enlarged and schematically illustrated cross-section along the line III—III in FIG. 2.

The spool 120 either has two axially adjacent chambers or consists as shown in the exemplary embodiment (see FIG. 3) of two laterally adjacent spool elements 120' and 120'', each of which is provided with two flanges and which are connected to each other by means of a shaft so as to rotate together. The first spool element 120' serves to receive the two fabric belts 109. The second spool element 120'' serves to receive a third fabric belt 118, which runs from the spool 120 to the spool 119 arranged on the storage shaft 102 after being diverted by an additional diverting roller 117 in the chamber of the guide rail 106 illustrated at the left in FIG. 2. The coiling direction of the third fabric belt 118 in the spool 120 is selected in such a manner that it is unwound as the fabric belts 109 are coiled up, and vice versa. Accordingly, the third fabric belt 118 is coiled onto the spool 119 as the fabric belts 109 on spool 120 are unwound.

A separating plate 129, through which the shaft passes, is stationarily arranged between the two spool elements 120' and 120''. This separating plate 129 extends beyond the spool flanges on all sides and extends to the crossbar 107 at the point where the fabric belts 109 and 118 enter between the flanges, i.e., on the side facing the yoke portion of the crossbar 107. This prevents the fabric belts 109 and 118 from improperly passing from one spool element to the other.

Figure 4:
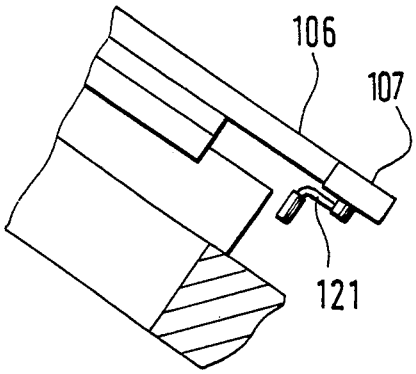
FIG. 4 is a partially illustrated cross-section of the second exemplary embodiment.

As shown in FIG. 4, a crank 121 is nondetachably connected with the shaft of the spool 120 and lies on the underside of the crossbar 107. When the crank 121 is turned in one rotational direction the two fabric belts 109 are coiled onto the spool 120. In this manner a tensile force is exerted on the lower end of the roll shutter plating 103 toward the crossbar 107. The third fabric belt 118 is thereby unwound from the spool 120 and coiled onto the spool 119. When the crank 121 is rotated in the opposite direction, the third fabric belt 118 is coiled onto the spool 120, whereby the storage shaft 102 is driven in the upwinding direction. Because the third fabric belt 118 is nonelastic, like the two other fabric belts 109, a smooth, uniform opening movement of the roll shutter plating 103 takes place, even under changing friction conditions. The helical spring 115, like the helical spring 15, is of such dimensions and bias strength that the fabric belts are continuously subjected to a tensile force that is sufficiently high to assure a uniform movement of the roll shutter plating, and a change in this tensile force does not adversely affect the movement of the roll shutter plating.

Figure 5:
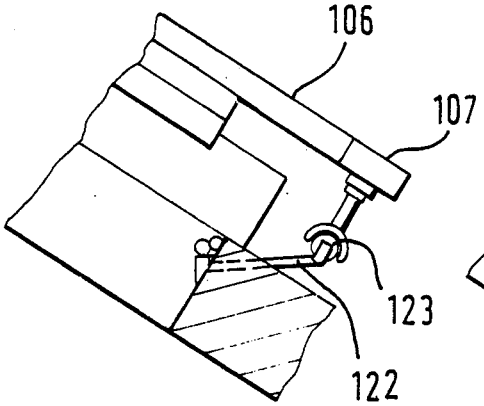
FIG. 5 is a cross-section according to FIG. 4 with a modification of the second exemplary embodiment.
Figure 6:
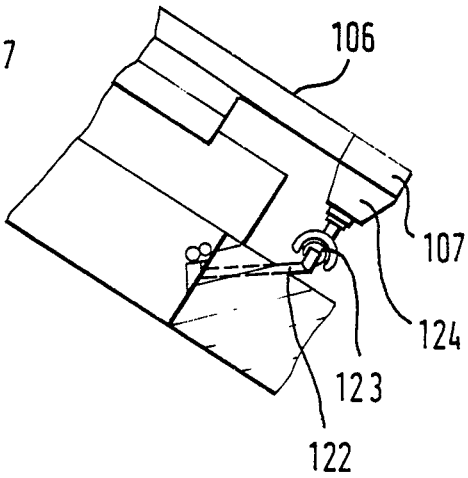
FIG. 6 is a cross-section according to FIG. 4 with a modification of the first exemplary embodiment.

As shown in FIGS. 5 and 6, a crank arranged on the inside of the hinged wing can also be provided in place of the crank 121 arranged on the underside of the crossbar 107. Such a crank is illustrated in FIGS. 5 and 6 parallel to the lower wing of the window frame. This crank could, however, also be detachably connected with the hinged wing. Through a bore in the lower wing of the window an intermediate shaft 122 leads from the inside crank to the outside to a cardan joint 123. In the modification according to FIG. 5 the cardan joint 123 is directly connected with the shaft of the spool 120. In the modification according to FIG. 6, however, the cardan joint 123 is connected with the input of a reduction gear 124, which is located in a housing arranged on the underside of the crossbar 107. The drive side of the reduction gear 124 is connected with the shaft of the spool 120.

In order to completely seal the window against light with the aid of the roll shutter, the inner surfaces of the two side members which border the inside and outside of the groove in the guide rails 106, and the crossbar 107 which receives the roll shutter plating 103, are provided with groove-like recesses 125, which extend in the longitudinal direction of the rails (see FIG. 7). The base of each longitudinally-extending light sealing element 126, which in the exemplary embodiment are formed as brushes, is located in one of these grooves 125. These light sealing elements 126 lie against the outside or inside of the roll shutter plating 103 so as to seal out light. As further shown in FIG. 7, the lower side member of the two guide rails 106 is provided with an additional recess 127, which is open toward the hinged wing and receives the base of a longitudinally extended light sealing element 128, which in the exemplary embodiment is also formed as a brush. The light sealing element 128 rests against the lateral side members of the hinged wing, so that light also may not pass between these side members and the guide rails 106.

Figure 8:
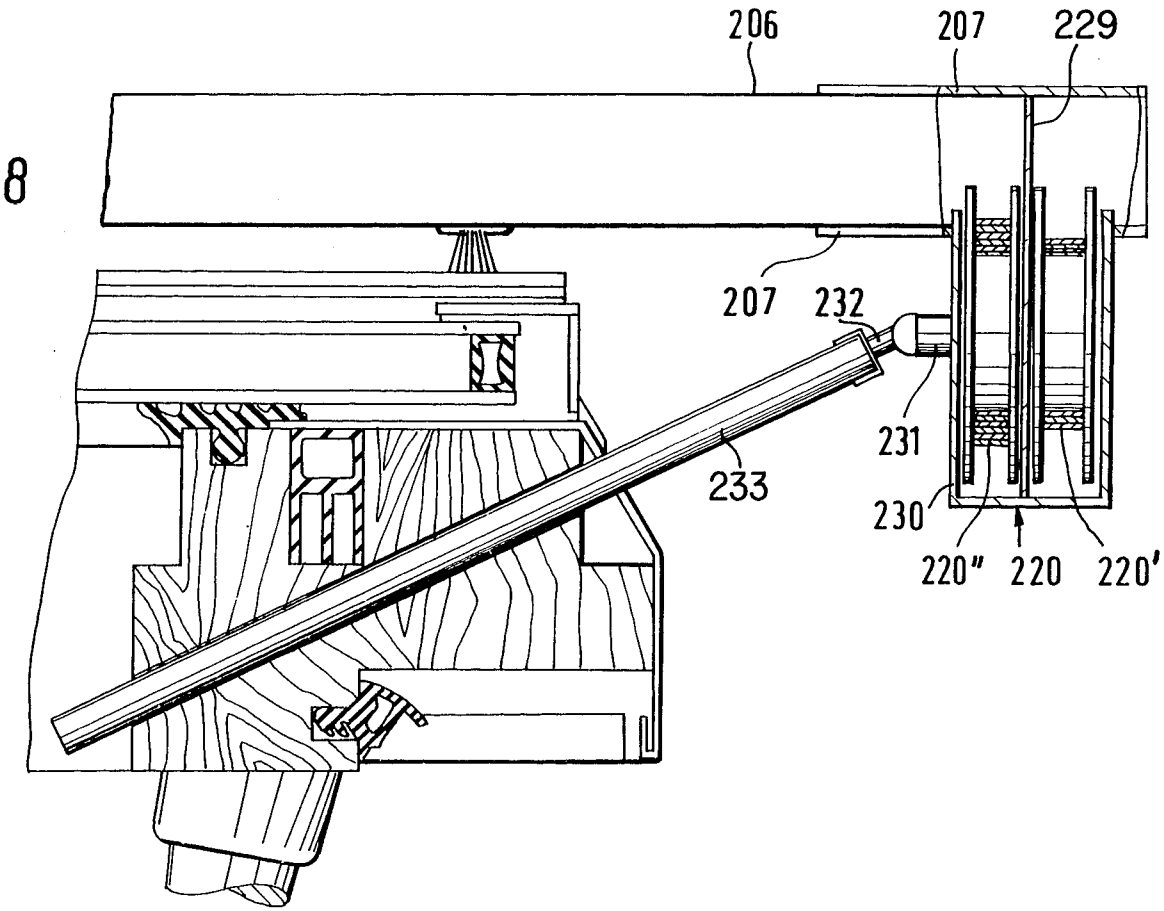
FIG. 8 is a cross-section of a third exemplary embodiment.

The exemplary embodiment illustrated in FIG. 8 differs from that according to FIG. 2 only by a different arrangement of its spools 220. Therefore, only this difference is discussed below. With regard to other details, reference should be made to the statements made concerning the second exemplary embodiment of the invention illustrated in FIG. 2.

A rectangular housing 230 is located on the side of the crossbar 207 facing the roof, which housing 230 opens toward the inner chamber of the crossbar 207. The crossbar is provided with a corresponding opening, so that the spool 220, which is rotatably mounted in the housing 230 can project into the crossbar. The shaft 231 of the spool 220 lies parallel to the longitudinal extension of the guide rails 206, and for this reason a universal joint 232, which connects the shaft 231 with a shaft 233 of a crank which passes through the hinged window frame, need only be set at a relatively small angle. The separating plate 229 provided between the two spool elements 220' and 220'' extends, as shown in FIG. 8, from the floor of the housing 230 up to the upper side member of the crossbar 207.

Of course, a reduction gear could be provided between the universal joint and the shaft 231, which could be attached to the housing 230 or could be joined therewith to form a single structural unit.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A roll shutter for roof windows, particularly those of the hinged casement-type construction, having (a) a roll shutter frame in which a storage shaft is rotatably arranged for receipt of roll shutter plating bars, (b) two guide rails which run parallel to each other and are adjacent to the roll shutter frame and which are provided for the ends of the roll shutter plating bars, and a crossbar which connects the guide rails with each other at their ends opposite the roll shutter frame, and (c) a roll shutter draw mechanism which includes two cords, one end of each of which is attached to the lower end of the roll shutter plating, the cords being connected with a drivable spool after being guided over stationary diverting elements, as well as a length compensating device having a diverting element which can slide against the force of an elastic member and over which the two cords are guided in tandem, the improvement wherein said length compensating device is a block and tackle arrangement which comprises at least three diverting elements, at least one of which is slidable and at least one of which is stationary, respectively, and wherein the cords are guided in alternating sequence over stationary and slidable diverting elements, wherein the slidable diverting elements are arranging in the crossbar so as to be capable of sliding in a longitudinal direction of the crossbar, and wherein the slidable diverting elements are arranged adjacent to each other in the longitudinal direction of the guide rails in a common holder.

2. A roll shutter according to claim 1, wherein the elastic member is a biased helical spring which lies in the crossbar, extending in the longitudinal direction thereof.

3. A roll shutter according to claim 1, wherein the cords are formed as nonelastic belts.

4. A roll shutter according to claim 1, wherein both an electric motor with a reversible direction of rotation and the spool are coupled with the storage shaft, and the cord extending to the spool runs in one of the two guide rails.

5. A roll shutter according to claim 1, and further including a crank for driving said drivable spool, said spool being mounted in said crossbar and having a first chamber to receive said common cord and a second chamber to receive an additional cord having an opposite winding direction, said additional cord being guided from said second chamber to a second spool arranged on the storage shaft so as to rotate therewith.

6. A roll shutter according to claim 5, wherein a gear arrangement is engaged between the crank and the shaft of said drivable spool that is driven thereby, said gear arrangement being rigidly connected with the crossbar.

7. A roll shutter according to claim 5, wherein the crank is nondetachably coupled with the spool shaft.

8. A roll shutter according to claim 5, wherein the crank is coupled with the spool shaft by means of a shaft which passes through one side of the window wing.

9. A roll shutter according to claim 1, wherein strip-like light sealing elements are arranged on the inner sides of the side members of the guide rails between which the roll shutter plating is located and/or on the underside of the crossbar facing the window wing.

10. A roll shutter for roof windows, particularly those of the hinged casement-type construction, having (a) a roll shutter frame in which a storage shaft is rotatably arranged for receipt of roll shutter plating bars, (b) two guide rails which run parallel to each other and are adjacent to the roll shutter frame and which are provided for the ends of the roll shutter plating bars, and a crossbar which connects the guide rails with each other at their ends opposite the roll shutter frame, and (c) a roll shutter draw mechanism which includes two cords, one end of each of which is attached to the lower end of the roll shutter plating, he cords being connected with a two-chambered drivable spool after being guided over stationary diverting elements, as well as a length compensating device having a diverting element which can slide against the force of an elastic member and over which the two cords are guided in tandem, the improvement wherein said length compensating device is a block and tackle arrangement which comprises at least three diverting elements, at least one of which is slidable and at least one of which is stationary, respectively, and wherein the cords are guided in alternating sequence over stationary and slidable diverting elements, wherein the two chambers of the spool are formed by respective spool elements which are provided with flanges, between which spool elements a separating plate is arranged which projects beyond the flange at least at that point where the cords enter between the flanges.

11. A roll shutter according to claim 1, wherein the spool is arranged in a housing provided on the underside of the crossbar so that it is directed toward the roof.

12. A roll shutter according to claim 11, wherein the shaft of the spool lies parallel to the longitudinal extension of the guide rails.

13. A roll shutter according to claim 1, wherein the at least three diverting elements of said length compensating device comprise two slidable diverting elements which are held together for sliding against the force of said elastic member and a stationary diverting element, and the cords are guided in alternating sequence over first one of said slidable diverting elements, next over said stationary diverting element, and then over the other of said slidable diverting elements.

14. A roll shutter according to claim 1, wherein the at least three diverting elements of the length compensating device comprise two stationary diverting elements and a slidable diverting element which is slidable against the force of said elastic member, and the cords are guided in alternating sequence over first one of said stationary diverting elements, next over said slidable diverting element, and then over the other of said stationary diverting elements.

15. A roll shutter according to claim 1, wherein the two cords, one end of each of which is attached to the lower end of the roll shutter plating, are joined to a single common cord after being guided over said stationary diverting elements, which common cord is guided to said drivable spool.

16. A roll shutter according to claim 1, wherein the two cords, one end of each of which is attached to the lower end of the roll shutter plating, after being guided over said stationary diverting elements, both extend together to said drivable spool, over which they are guided.

* * * * *